United States Patent [19]

O'Neil et al.

[11] Patent Number: 4,815,604

[45] Date of Patent: Mar. 28, 1989

[54] NESTABLE PAINT ROLLER TRAY WITH MULTIPLE FEATURES

[75] Inventors: Robert A. O'Neil, Glen Ellyn; Leon Clouser, Lombard; Insoon Park, Chicago; Victor Milas, Hanover Park, all of Ill.

[73] Assignee: EZ Paintr Corporation, Milwaukee, Wis.

[21] Appl. No.: 162,444

[22] Filed: Mar. 1, 1988

[51] Int. Cl.[4] ..... B65D 21/00; B65D 85/62; B44D 3/12

[52] U.S. Cl. ..... 206/518; 220/1 R; 15/257.06

[58] Field of Search ..... 206/518; 220/1 R; 15/257.06

[56] References Cited

U.S. PATENT DOCUMENTS

| | | | |
|---|---|---|---|
| 2,909,797 | 9/1957 | White | 220/1 R |
| 4,010,866 | 3/1977 | McClane | 220/1 R |
| 4,102,468 | 7/1978 | Goldman | 206/518 |
| 4,164,803 | 8/1979 | Zurawin et al. | 15/257.06 |
| 4,445,250 | 5/1984 | Seidl | 15/257.06 |

*Primary Examiner*—George T. Hall
*Attorney, Agent, or Firm*—James G. Staples

[57] ABSTRACT

A tray for coating fluids and paints for use with a roller comprising a deep well section, a gradually-sloped section, a brush rest section, tray legs extending downward along a slanted vertical line, horizontal extensions at the bottom of said tray legs, substantially vertical walls terminating in a wall lip at a uniform height, said tray being characterized by an underside which is generally complementary to the configuration of the top side, said tray being stabilized by a plurality of ribs extending generally longitudinally of said tray beneath the brush rest section, whereby a plurality of said trays may be nested within each other when not in use, and being further characterized by an excellent rigidity of structure and minimal deformation when said tray is in use and filed with a coating fluid.

12 Claims, 3 Drawing Sheets

10
11
12
14
15
16
17
18
19
20
21
22
23
24
25
26
27
28
29
30
31
32
33
34
3
5
7

Fig. 4.
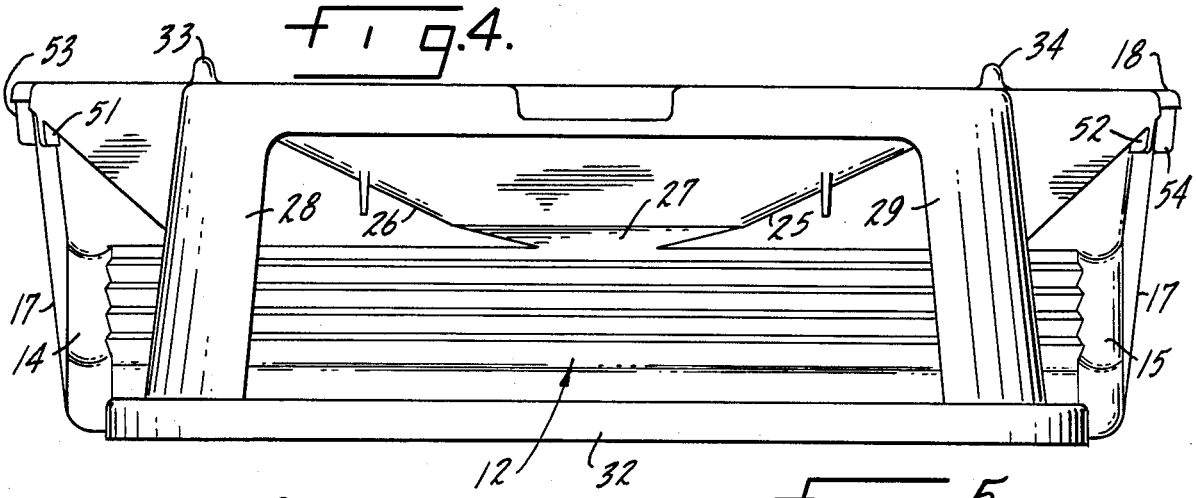
Fig. 5.
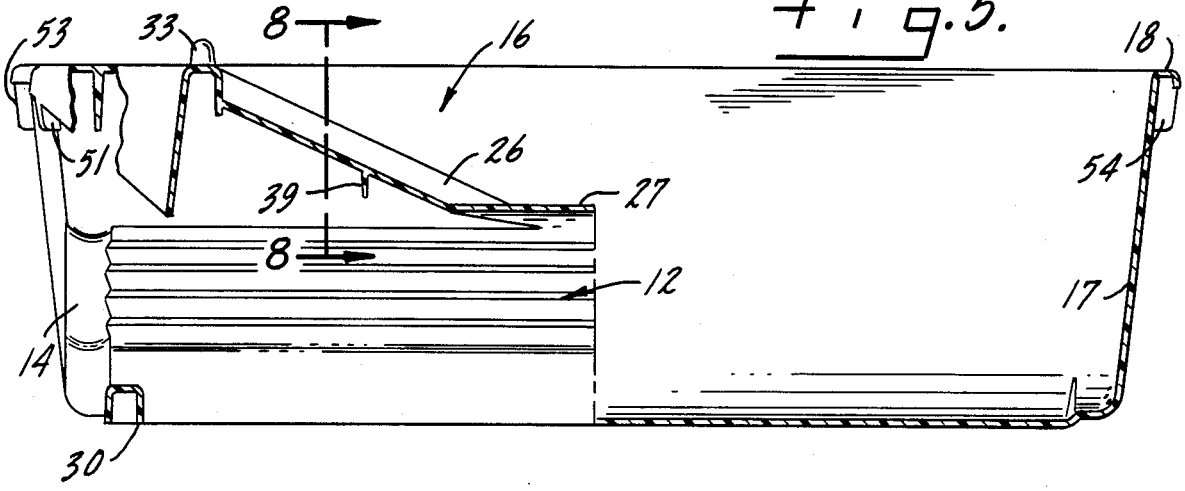
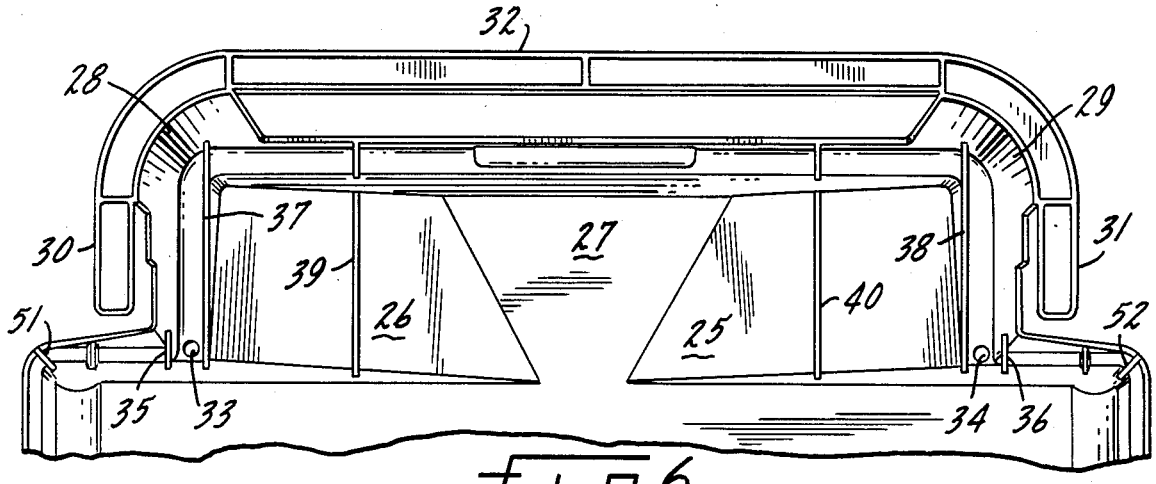
Fig. 6.
Fig. 7.
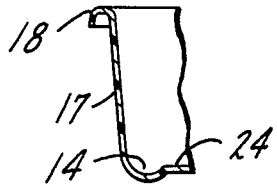
Fig. 8.
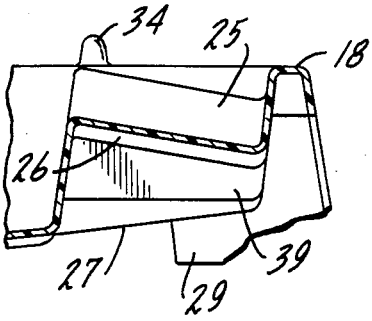

NESTABLE PAINT ROLLER TRAY WITH MULTIPLE FEATURES

BACKGROUND OF THE INVENTION

1. Field of the Invention

The present invention relates generally to a tray for paint and other coating fluids and specifically to a tray for use with a roller and, as needed, a brush, which tray is nestable with like trays, has excellent torsional stability, and includes an integral step ladder fitup, a frame catch and a brush rest, all of which features are achieved by a construction which requires less material than comparable trays and, therefore, can be provided to the consumer at lower cost.

2. Description of the Prior Art

Trays for use with paint rollers are well known, and are available in a variety of materials and separate styles. In one well-known form the tray is made of rigid metal material and contains two metal strips or legs which are riveted or welded onto the bottom side of the tray for clamping the tray onto a stepladder. These metal trays are not easily nor compactly stored nor efficiently packed for shipment, as the metal legs eliminate the possibility of nesting several such trays within each other for compact grouping.

Similarly, plastic trays have been made with comparable designs. Like the metal trays, the plastic trays generally have features which prevent easy nesting and storage of a multiple of such trays.

Plastic paint roller trays which are easily nested and stored have been manufactured without effective clamp-on legs. It appears that the trade-off for gaining the advantage of nestability is the loss of effective and functional clamp-on legs, which is a strong marketing feature of such trays.

Plastic trays also are typically less rigid than their counterpart metal trays, making it difficult to transport and carry the tray when it is loaded with paint or other coating fluid. Previously, rigidity in plastic trays was often accomplished by using a thicker tray wall design, which necessitates using more material and hence increases the cost of the tray.

Many such trays currently on the market do not include a convenient platform or location on which to rest a paintbrush, and no instances are known of this feature being available in a tray together with all the foregoing features. Because most individuals who use paint roller trays frequently use both a roller and a paint brush to accomplish their work, a platform for resting a conventional paint brush is a desirable use and marketing feature.

SUMMARY OF THE INVENTION

The present invention is a tray for paints and other coating fluids which may be used with a roller and a brush and which has the features of a step ladder fitup and a brush rest. Further advantages of the tray include excellent rigidity and stability when filled with a paint or other coating fluid. In addition to all of the foregoing, the tray of this invention may be manufactured with a minimum of material, thus minimizing its overall cost.

Accordingly it is an object of this invention to provide a tray for paints and other coating fluids which may be nested for easy and compact packing of a multiple of such trays while, at the same time, having an effective ladder fitup feature and a brush rest.

Yet another object of this invention is to provide a low-cost tray for paints and other coating fluids which, in addition to being nestable and having the ladder fitup and brush rest features, is substantially rigid such that it may transported or carried without buckling when full of paint or other coating fluids.

Still another object of this invention is to provide a tray for paints and other coating fluids which may be manufactured at a low cost out of a minimum of inexpensive materials.

Other objects and advantages of the invention will become apparent from the following description of the invention.

DESCRIPTION OF THE DRAWINGS

FIG. 4 is an end view of the tray of the present invention, as seen from the end in which the brush rest section is located (i.e. the right end as viewed in FIG. 1);

FIG. 5 is the same end view, partially cut away and taken substantially along line 5—5 of FIG. 1, of the tray of the present invention;

FIG. 6 is a partial bottom view illustrating particularly the tray legs and clamp-on feature, and the strengthening ribs, of the present invention;

FIG. 7 is a section of the tray wall taken substantially along line 7—7 of FIG. 1; and FIG. 8 is a section view of the brush rest taken substantially along line 8—8 of FIG. 5.

DESCRIPTION OF THE PREFERRED EMBODIMENT

Figure 1:
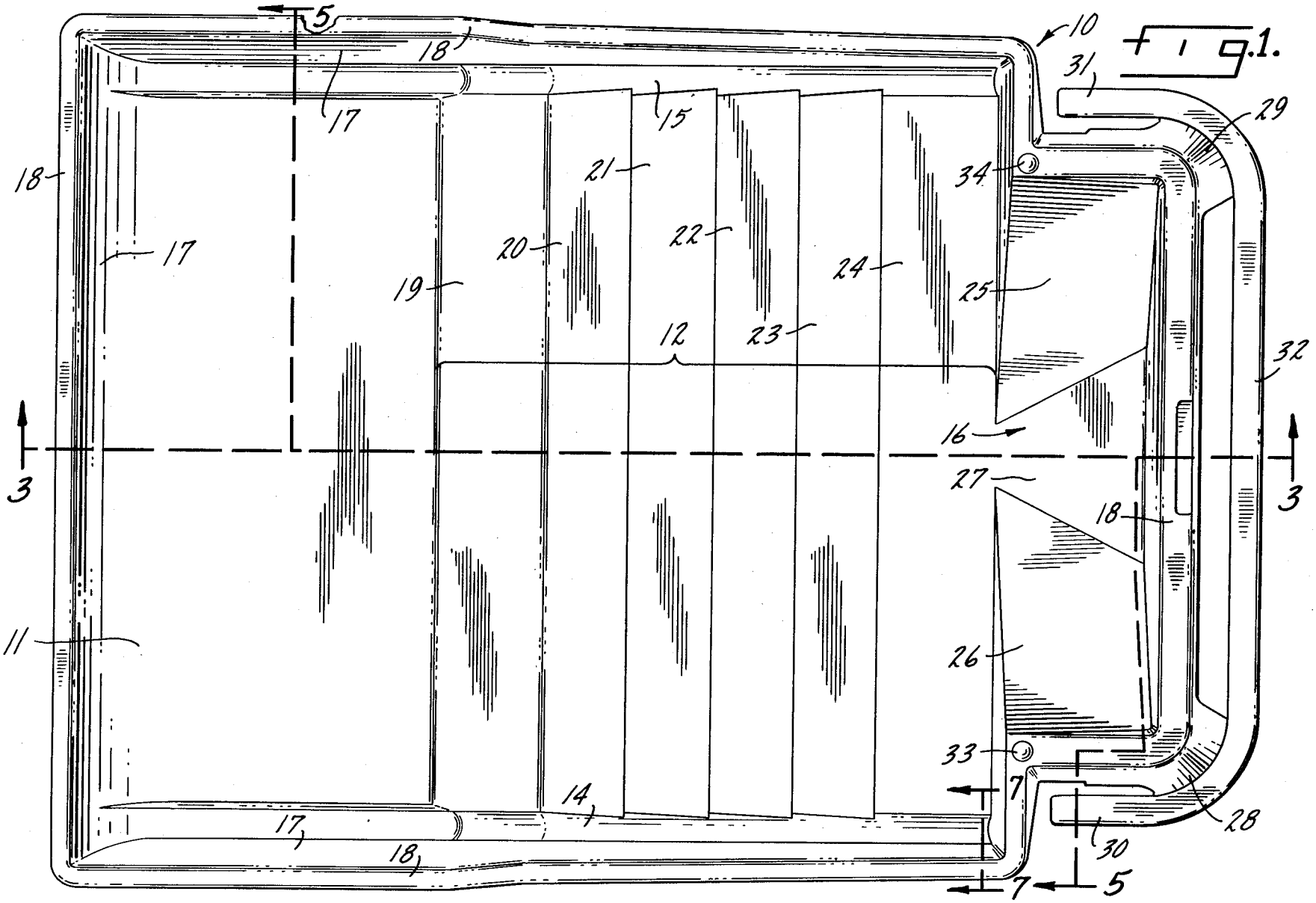
FIG. 1 is a top plan view of the preferred embodiment of the tray for paints and other coating fluids of the present invention.

Like reference numerals will be used to describe like parts from Figure to Figure.

The tray of the present invention is shown generally at 10 in FIG. 1. The tray comprises a deep well section 11, an inclined rollout section 12, gutters 14 and 15 at the outer boundaries of the rollout section, a brush rest section indicated generally at 16, shown best in FIGS. 1, 2, 3 and 5, and substantially vertical walls 17 which surround the entire tray and which rise to a uniform height and terminate in wall lip 18, see FIG. 5. In the embodiment depicted in FIG. 1, the inclined rollout section 12 further comprises a series of slanted steps 19–24 which originate in the deep well section 11 and slope upward to the brush rest section 16. The bottom of the gutters 14 and 15 lie in a plane which is situated below the plane of the adjacent portion of the inclined rollout . As shown best in FIGS. 1, 3 and 5 the brush rest section 16 is shown as two slanted planes 25 and 26 which slope downward from the outer edges of the brush rest section toward the center 27. The two planes are also slightly rearwardly sloped, as clearly depicted in FIG. 4. The rearward slope allows a brush to be rested therein, without accidentally slipping into the sloped section 12 or the deep well 11.

The support structure of the tray consists of the tray legs 28, 29, the stepladder clamps 30 and 31, and the continuous bar 32, which bar is located in the same elevation as the stepladder clamps or fitups 30 and 31. The wall lip 18 surrounds the top of the entire tray structure, and facilitates the pouring of paints or coating fluids out of the tray at the corners of the deep well section 11.

Also shown in FIG. 1 are two roller frame and brush catches 33 and 34, which prevent a roller frame or brush handle from slipping into the deep well section 11 when the roller or paint brush is rested in the brush rest section 16.

The tray legs 28, 29, the stepladder clamps 30, 31 and the continuous bar structure 32 provide substantial rigidity to the tray.

Figure 2:
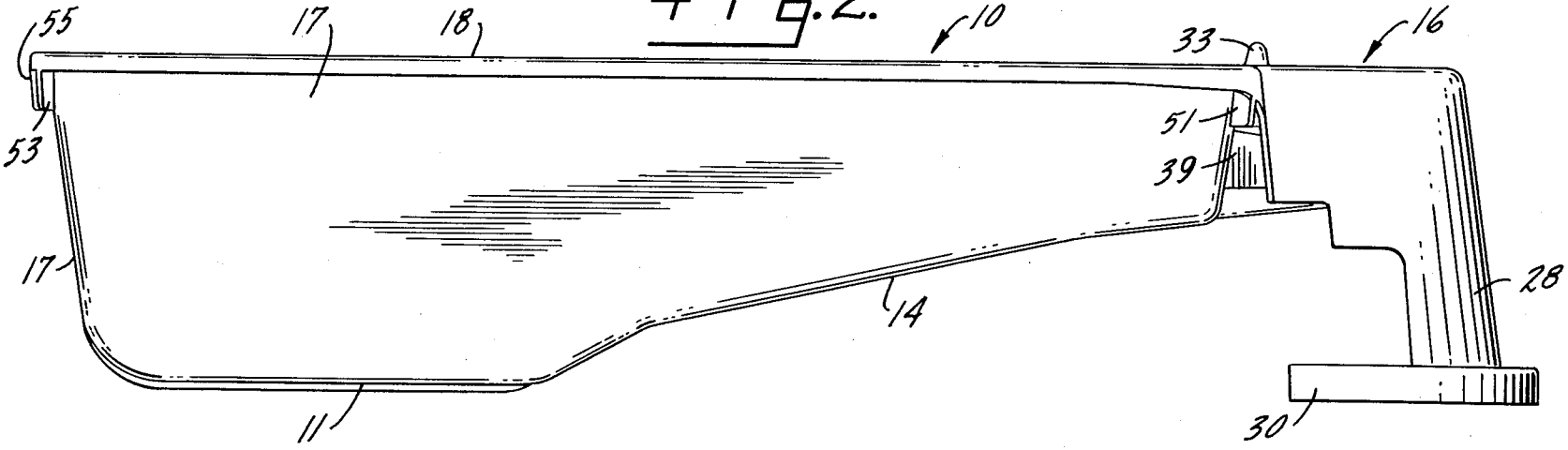
FIG. 2 is a side view of the tray of the present invention.

It will be observed from FIG. 2 that the inclined rollout section 12 need not be of constant slope, but rather may vary in steepness from the deep well section 11 up through the brush rest section 16. FIG. 2 further illustrates the downwardly, slightly outwardly extending legs which outward extension provides the nestability of the tray. A slant of about 10° from the vertical is ideal. Also apparent in FIG. 2 is the forward rib 55, which further enhances the rigidity of the tray.

Figure 3:
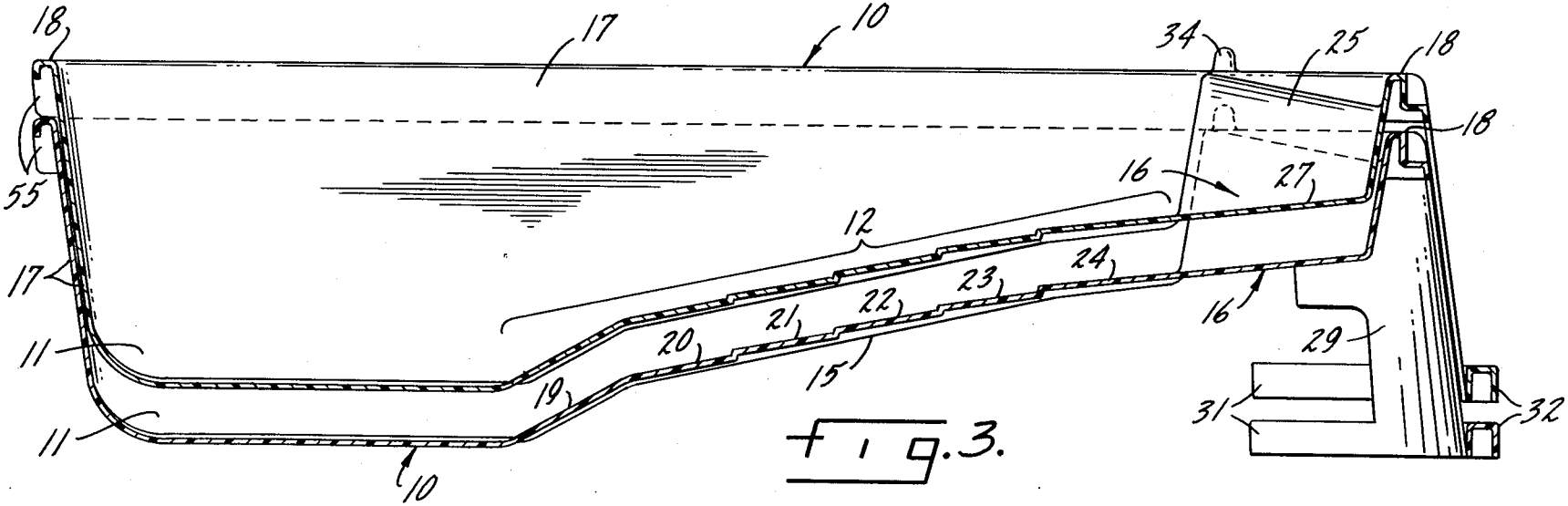
FIG. 3 is a cross-sectional view, taken substantially along line 3—3 of FIG. 1, of two trays of the present invention shown stacked and nested one within the other.

FIG. 3 further depicts the nestability of the tray. The construction allows for near-perfect nesting of one tray in the other, thus minimizing the amount of floor and storage space required to store a multiple of the trays of the present invention. The preferred embodiment of the tray is constructed such that when nested or stacked in a bottom tray, the top tray rises only approximately 1.5 cm. above the bottom tray. In one embodiment, twelve of such trays, each of which held more than $\frac{2}{3}$ of a quart, occupied a volume of only approximately 4600 sq. cm.

The brush rest section 16 of the tray is best illustrated in FIGS. 1, 4, 5 and 6. From these figures it will be noted that the brush rest includes two planes 25 and 26 which slope downwardly toward the center of the tray, shown best in FIG. 5, and slightly rearwardly (as shown in FIG. 1), shown best in FIGS. 1, 3 and 8. The inclined surfaces 25 and 26 stop short of meeting at the center, forming a central, generally flat bottom surface 27. The slight rearward inclination of side planes 25 and 26 helps preclude a paint brush which is placed in the brush rest from falling downwardly into the rollout section 12 or deep well 11.

A series of ribs 35, 36, and 37, 38, and 39, 40, and 41, 42, located on the underside of the brush rest section 16 contribute to the rigidity and nested stability of the tray. The ribs are placed to produce substantial rigidity with a minimum of material. Ribs 35 and 37 provide a compartment into which the roller frame/brush catch nub 33 is received, and ribs 36 and 38 provide a receptacle which receives nub 34. These ribs enhance the rigidity of the tray to the point where the tray, when filled with paint, may be picked up at the shallow end, where the maximum force lever is exerted on the tray, without buckling.

Another series of stiffening ribs 51, 52, and 53, 54, and 55, located beneath the wall lip 18, shown best in FIGS. 2, 3, 4, 5, and 6, also contribute to the rigidity and nested stability of the tray, and define the plane upon which an upper tray will rest when nested in a lower tray.

FIG. 7 illustrates particularly the relationship between the gutter 14 and a step in inclined slope 24.

FIG. 8 illustrates particularly clearly the relationship of one of the inclined surfaces of the brush rest to its adjacent structure.

The tray of the present invention is ideally constructed of a high-density, high-impact plastic, such as polyethylene or polypropylene. Any well-known process such as injection molding is acceptable for manufacturing the tray. The strong, light weight feature of the tray can be appreciated from the fact that a $\frac{2}{3}$ quart capacity tray constructed of polypropylene substantially as above described will weigh only a little more than 0.57 of a pound.

The present invention has been described in connection with a preferred and exemplary embodiment thereof. As many variations and modifications of the present invention will be obvious to those skilled in the art, it is apparent that the scope of the invention should be determined, not by the specific disclosures herein but rather, by the appended claims, when construed herewith regard to the relevant prior art.

We claim:

1. In a paint tray having a continuous wall means, means forming a deep well section at one end of the tray, means forming a brush rest section within the closed wall means at the other end of the tray, means forming a rollout section which opens, at its lower end portion, into the deep well section and, at its upper end portion, into the brush rest section, and ladder fitup means integral with the wall means at the brush rest section of the tray, said wall means and ladder fitup means being contoured so as to enable the tray to be stacked and nested with one or more identical trays.

2. The paint tray of claim 2 further characterized in that the ladder fitup means includes leg means extending generally downwardly from the brush rest section end of the tray and a pair of ladder engagement members, one adjacent each side of the tray, each being constructed and arranged to receive a ladder platform in a maw formed beneath the brush rest section and above said ladder engagement members.

3. The paint tray of claim 2 further characterized in that the latter engagement members are the terminal ends of a continuous bar which extends a substantial portion of the width of the tray at a level beneath the brush rest section, said terminal ends being oriented substantially perpendicularly to the orientation of the continuous bar which extends a substantial portion of the width of the tray.

4. The paint tray of claim 3 further characterized by and including reinforcement rib means projecting downwardly from the underside of the brush rest section, and roller frame/handle catch means extending upwardly from the continuous wall means, said reinforcement rib means and roller frame/handle catch means being vertically aligned with one another so that the stacking nub means of a lower tray are received within the reinforcement rib means of an upper tray in nested relationship.

5. The paint tray of claim 4 further characterized by and including a flattened continuous wall lip in which the wall means terminate, a plurality of peripheral reinforcement rib means projecting downwardly from the underside of the outer portion of the flattened wall lip, said peripheral reinforcement rib means being vertically aligned with one another and extending downwardly to a uniform distance such that, when one tray is nested in another, the bottom edges of the peripheral reinforcement rib means of the top tray contract the upper edge of the wall means of the bottom tray.

6. The paint tray of claim 5 further characterized by and including means for collecting excess coating materials in the inclined rollout section of the tray and directing collected excess material to the deep well portion of the tray, said means including a gutter at each side of the inclined rollout section, the bottom of which is beneath the elevation of the inclined rollout section at any longitudinal location along he inclined rollout section.

7. A tray for coating fluids for use with a roller, said tray including a deep well section comprising a coating fluid reservoir, a gradually-sloped section slanting up from said reservoir, a brush rest section at the upper end of said gradually-sloped section, tray legs extending downward along an outwardly and downwardly inclined line from the end of said tray which comprises said brush rest section, horizontal extensions at the bottom of said tray legs for engaging said tray with a platform of a stepladder, an interconnecting solid bar perpendicular to said tray legs and running substantially along the lower outer perimeter of the brush rest end of said tray, and substantially vertical walls along the perimeter of said tray, said walls rising to a uniform elevation, said tray for coating fluids being characterized by a complementarily contoured underside whereby a plurality of said trays ma be nested within each other for compact storage when not in use, and said tray for coating fluids being further characterized by a series of axial ribs which provide a rigidity of structure and minimal deformation when said tray is in use and filled with a coating fluid.

8. A tray for coating fluids according to claim 7 wherein said gradually-sloped section comprises a series of slanted steps.

9. A tray for coating fluids according to claim 7 wherein said brush rest section is characterized by dual mirror-image sloped surfaces which rise from the center portion of said tray up toward the side walls of said tray, and which slant rearwardly away from said deep well and said gradually-sloped sections.

10. A tray for coating fluids according to claim 7 further including dual gutters which slant up from said deep well section along lines parallel to and lower than the line along which said gradually-sloped section rises, said dual gutters being substantially adjacent to the wall edges along the major length dimension of said tray.

11. A tray for coating fluids according to claim 7, wherein said tray is composed of a material in the group consisting of polypropylene, high density polyethylene, regrind polypropylene resin, and reprocessed polypropylene resin.

12. A tray for coating fluids according to claim 7 wherein the slanted vertical line along which the tray legs extend downward is at an angle in the range of from about 5° to about 20° from a perpendicular vertical line.

* * * * *

US004815604B1

REEXAMINATION CERTIFICATE (1898th)

United States Patent [19]

O'Neil et al.

[11] B1 4,815,604

[45] Certificate Issued Jan. 12, 1993

[54] NESTABLE PAINT ROLLER TRAY WITH MULTIPLE FEATURES

[75] Inventors: Robert A. O'Neil, Glen Ellyn; Leon Clouser, Lombard; Insoon Park, Chicago; Victor Milas, Hanover Park, all of Ill.

[73] Assignee: EZ Paintr Corporation, Milwaukee, Wis.

Reexamination Request:
No. 90/002,449, Sep. 27, 1991

Reexamination Certificate for:

| | |
|---|---|
| Patent No.: | 4,815,604 |
| Issued: | Mar. 28, 1989 |
| Appl. No.: | 162,444 |
| Filed: | Mar. 1, 1988 |

[51] Int. Cl.[5] ..... B65D 21/02; B65D 85/62

[52] U.S. Cl. ..... 206/518; 206/519; 220/570; 220/736; 15/257.06; 248/238

[58] Field of Search ..... 220/570, 480, 475, 23.83, 220/23.86, 735, 736; 206/518, 519; 248/210, 238; 15/257.06; D32/53.1

[56] References Cited

U.S. PATENT DOCUMENTS

| | | | |
|---|---|---|---|
| D. 193,382 | 4/1975 | Goetz . | |
| D. 273,725 | 5/1984 | Goetz . | |
| D. 280,855 | 10/1985 | Smith . | |
| D. 302,614 | 8/1989 | Beatty | D32/53.1 |
| D. 302,881 | 8/1989 | Lussier et al. | D32/53.1 |
| 2,444,584 | 7/1948 | Touchett | 220/570 |
| 2,519,666 | 4/1950 | Knox | 206/518 |
| 2,659,917 | 11/1953 | Drum | 15/257.6 |
| 2,694,825 | 11/1954 | Touchett et al. . | |
| 2,896,809 | 7/1959 | Metzger et al. | 206/515 |
| 2,909,797 | 10/1959 | White . | |
| 2,917,764 | 12/1959 | Whittle | 220/570 |
| 3,033,437 | 5/1962 | Wrage | 15/257.06 |
| 3,837,034 | 9/1974 | Leffert et al. | 220/570 |
| 4,010,866 | 3/1977 | McClane . | |
| 4,102,468 | 7/1978 | Goldman . | |
| 4,164,299 | 8/1979 | Fuhr . | |
| 4,164,803 | 8/1979 | Zurawin et al. . | |
| 4,445,250 | 5/1985 | Seidl . | |
| 4,669,609 | 6/1987 | Lugo | 15/257.06 |
| 4,815,604 | 3/1989 | O'Neil et al. | 206/518 |

FOREIGN PATENT DOCUMENTS

| | | | |
|---|---|---|---|
| 2706001 | 8/1978 | Fed. Rep. of Germany | 220/570 |
| 369401 | 6/1963 | Switzerland | 206/518 |
| 1547231 | 6/1979 | United Kingdom | 220/570 |

*Primary Examiner*—Allan N. Shoap

[57] ABSTRACT

A tray for coating fluids and paints for use with a roller comprising a deep well section, a gradually-sloped section, a brush rest section, tray legs extending downward along a slanted vertical line, horizontal extensions at the bottom of said tray legs, substantially vertical walls terminating in a wall lip at a uniform height, said tray being characterized by an underside which is generally complementary to the configuration of the top side, said tray being stabilized by a plurality of ribs extending generally longitudinally of said tray beneath the brush rest section, whereby a plurality of said trays may be nested within each other when not in use, and being further characterized by an excellent rigidity of structure and minimal deformation when said tray is in use and filed with a coating fluid.

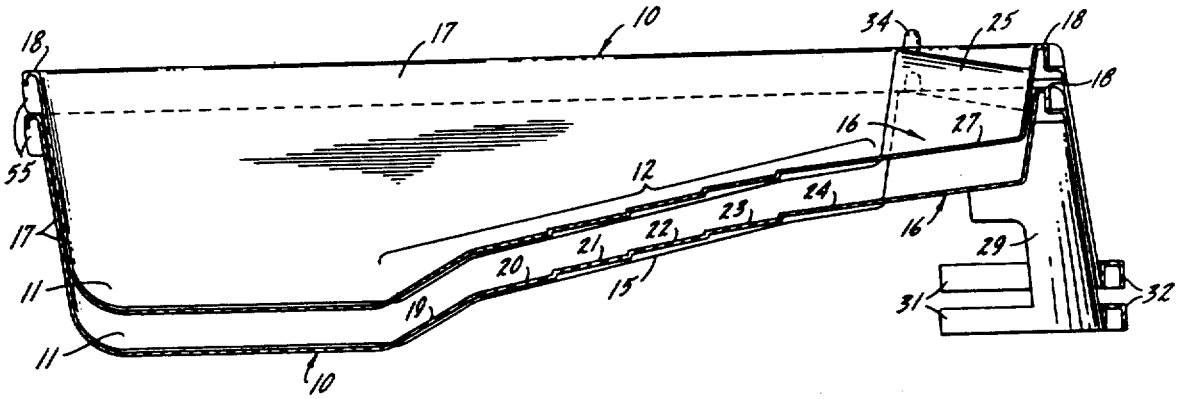

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, line 67–Column 3, line 6:

The support structure of the tray consists of the tray legs 28, 29, the stepladder clamps 30 and 31, and the continuous bar *or horizontal connecting member* 32, which bar is located in the same elevation as the stepladder clamps or fitups 30 and 31. *As best seen in FIGS. 1 and 2, the clamps or fitups 30 and 31 here form terminal extensions which extend from the continuous bar 32.* The wall lip 18 surrounds the top of the entire tray structure, and facilitates the pouring of paints or coating fluids out of the tray at the corners of the deep well section 11.

AS A RESULT OF REEXAMINATION, IT HAS BEEN DETERMINED THAT:

The patentability of claims 1–12 is confirmed.

New claims 13–18 are added and determined to be patentable.

*13. A tray for coating fluids for use with a roller, said tray including*

*a deep well section comprising a coating fluid reservoir,*

*a gradually-sloped section slanting up from said reservoir,*

*a brush rest section at the upper end of said gradually-sloped section,*

*tray legs extending downward along an outwardly and downwardly inclined line from the end of said tray which comprises said brush rest section,*

*a horizontal connecting member attached outwardly from the bottom of said tray legs, said connecting member including terminal extensions projecting toward said reservoir for engaging said tray with a platform of a stepladder, and*

*substantially vertical walls along the perimeter of said tray, said walls rising to a uniform elevation,*

*said tray for coating fluids being characterized by a complementarily contoured underside whereby a plurality of said trays may be nested within each other for compact storage when not in use, and*

*said tray for coating fluids being further characterized by a series of axial ribs which provide a rigidity of structure and minimal deformation when said tray is in use and filled with a coating fluid.*

*14. A tray for coating fluids according to claim 13 wherein said gradually-sloped section comprises a series of slanted steps.*

*15. A tray for coating fluids according to claim 13 further including*

*dual gutters which slant up from said deep well section along lines parallel to and lower than the line along which said gradually-sloped section rises, said dual gutters being substantially adjacent to upper edges of those of said walls along the major length dimension of said tray.*

*16. A tray for coating fluids according to claim 13 wherein said tray is composed of a material in the group consisting of polypropylene, high density polyethylene, regrind polypropylene resin, and reprocessed polypropylene resin.*

*17. A tray for coating fluids according to claim 13 wherein said tray legs extend downward at an angle in the range of from about 5° to about 20° from a perpendicular vertical line.*

*18. In a paint tray having a continuous wall,*

*means forming a deep well section at one end of the tray,*

*means forming a rollout section which opens, at its lower end portion, into the deep well section and,*

*at its upper end portion, into a brush rest section,*

*tray legs extending downward along an outwardly and downwardly inclined line from the end of said tray which comprises said brush rest section,*

*substantially vertical walls along the perimeter of said tray, said walls rising to a uniform elevation,*

*a ladder fitup integral with the tray legs at the brush rest section of the tray, said tray legs and ladder fitup being contoured so as to enable the tray to be nested with one or more identical trays,*

*said ladder fitup including terminal extensions projecting toward said deep well section for engaging said tray with a platform of a stepladder.*

* * * * *